US011761291B2

(12) United States Patent
Holberg et al.

(10) Patent No.: US 11,761,291 B2
(45) Date of Patent: Sep. 19, 2023

(54) WELLHEAD ARRANGEMENT AND METHOD

(71) Applicant: AKER SOLUTIONS AS, Lysaker (NO)

(72) Inventors: Geir Ivar Holberg, Oslo (NO); Joakim Martens, Oslo (NO); Kristian Guttulsrud, Oslo (NO); Jan Herland, Nesbru (NO); Jan Troensdal, Oslo (NO)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 16/604,184

(22) PCT Filed: Apr. 12, 2018

(86) PCT No.: PCT/NO2018/050101

§ 371 (c)(1),
(2) Date: Oct. 10, 2019

(87) PCT Pub. No.: WO2018/190727

PCT Pub. Date: Oct. 18, 2018

(65) Prior Publication Data

US 2020/0063520 A1 Feb. 27, 2020

(30) Foreign Application Priority Data

Apr. 12, 2017 (NO) ..... 20170625

(51) Int. Cl.
*E21B 33/124* (2006.01)
*E21B 33/043* (2006.01)
*E21B 34/04* (2006.01)
*E21B 33/035* (2006.01)

(52) U.S. Cl.
CPC ..... *E21B 33/124* (2013.01); *E21B 33/035* (2013.01); *E21B 33/043* (2013.01); *E21B 34/04* (2013.01)

(58) Field of Classification Search
CPC ..... E21B 33/124; E21B 33/043; E21B 33/03; E21B 33/035; E21B 34/04
See application file for complete search history.

(56) References Cited

U.S. PATENT DOCUMENTS 3,800,869 A 4/1974 Herd et al.
5,201,835 A * 4/1993 Hosie ..... E21B 33/03 277/314
6,039,120 A * 3/2000 Wilkins ..... E21B 33/03 166/242.1
6,705,401 B2 3/2004 Buckle et al.
7,559,366 B2 7/2009 Hunter et al.
(Continued)

FOREIGN PATENT DOCUMENTS

CN 101858203 A 10/2010
CN 102808590 A 12/2012
(Continued)

*Primary Examiner* — Abby J Flynn
*Assistant Examiner* — Yanick A Akaragwe
(74) *Attorney, Agent, or Firm* — Norman B. Thot

(57) ABSTRACT

A wellhead arrangement includes a valve tree arranged on a wellhead and a seal carrier with at least one seal. The valve tree includes an isolation sleeve. The seal carrier is arranged between the wellhead and the isolation sleeve.

18 Claims, 2 Drawing Sheets

(56) References Cited

U.S. PATENT DOCUMENTS

| | | | | |
|---|---|---|---|---|
| 7,743,824 | B2 | 6/2010 | Lam et al. | |
| 8,286,717 | B2 | 10/2012 | Giroux et al. | |
| 8,316,946 | B2 | 11/2012 | June et al. | |
| 8,393,400 | B2 | 3/2013 | Buckle | |
| 8,746,352 | B2 | 6/2014 | Shaw | |
| 8,851,194 | B2 | 10/2014 | Ford et al. | |
| 8,997,883 | B2 | 4/2015 | Gette et al. | |
| 9,382,771 | B2 * | 7/2016 | Hart | E21B 33/038 |
| 9,464,497 | B2 | 10/2016 | Kekarainen | |
| 2002/0062964 | A1 | 5/2002 | Allen | |
| 2006/0185841 | A1 | 8/2006 | Swagerty et al. | |
| 2009/0230632 | A1 * | 9/2009 | Petrash | F16J 15/56 277/584 |
| 2010/0206575 | A1 | 8/2010 | Theiss et al. | |
| 2012/0097399 | A1 | 4/2012 | Kobata et al. | |
| 2012/0285676 | A1 | 11/2012 | Shaw | |
| 2013/0069315 | A1 | 3/2013 | Kekarainen | |
| 2013/0175055 | A1 * | 7/2013 | Hart | E21B 33/03 166/387 |
| 2013/0341051 | A1 | 12/2013 | Higgins et al. | |
| 2014/0020900 | A1 | 1/2014 | Nguyen et al. | |
| 2014/0069646 | A1 | 3/2014 | Barnhart et al. | |

FOREIGN PATENT DOCUMENTS

| | | | |
|---|---|---|---|
| CN | 104379867 | A | 2/2015 |
| CN | 104884732 | A | 9/2015 |
| CN | 105143595 | A | 12/2015 |
| RU | 2 348 791 | C2 | 3/2009 |
| RU | 2 352 756 | C1 | 4/2009 |
| WO | WO 99/04137 | A1 | 1/1999 |

* cited by examiner

WELLHEAD ARRANGEMENT AND METHOD

CROSS REFERENCE TO PRIOR APPLICATIONS

This application is a U.S. National Phase application under 35 U.S.C. § 371 of International Application No. PCT/NO2018/050101, filed on Apr. 12, 2018 and which claims benefit to Norwegian Patent Application No. 20170625, filed on Apr. 12, 2017. The International Application was published in English on Oct. 18, 2018 as WO 2018/190727 A1 under PCT Article 21(2).

FIELD

The present invention relates to a wellhead arrangement, and more particularly to a system and method relating to the arrangement of a valve tree on a wellhead.

BACKGROUND

Wellheads and valve trees (so-called Christmas trees or Xmas trees) are widely used in petroleum exploitation. Such units are safety-critical components which handle fluids under very high pressures under challenging conditions. Their reliability and operational safety are therefore essential because any damage or failure can have very serious environmental, health-and-safety, and economic consequences.

A particular challenge exists during installation or removal operations during which it is essential that a correct positioning of components, a mating of connectors, and the securing of parts in relation to each other be achieved. Direct access to such components or connectors for inspection or manual intervention is in many cases not available, for example, when installing subsea trees. For this reason, a continuous need exists for improved methods and systems for wellheads and valve trees, to provide their integrity and operational safety, and to minimize the risk of failure.

Documents which can be useful for understanding the background include: U.S. Pat. No. 6,039,120; US 2002/0062964; AU 1997/35509; U.S. Pat. Nos. 9,464,497; 8,286,717; 8,851,194; 8,997,883; 7,559,366; 8,746,352; 8,393,400; and 3,800,869.

SUMMARY

An aspect of the present invention is to provide a wellhead arrangement which provides advantages over known solutions and techniques mentioned above or in other areas.

In an embodiment, the present invention provides a wellhead arrangement which includes a valve tree arranged on a wellhead and a seal carrier comprising at least one seal. The valve tree comprises an isolation sleeve. The seal carrier is arranged between the wellhead and the isolation sleeve.

BRIEF DESCRIPTION OF THE DRAWINGS

The present invention is described in greater detail below on the basis of embodiments and of the drawings in which.

DETAILED DESCRIPTION

Figure 1:
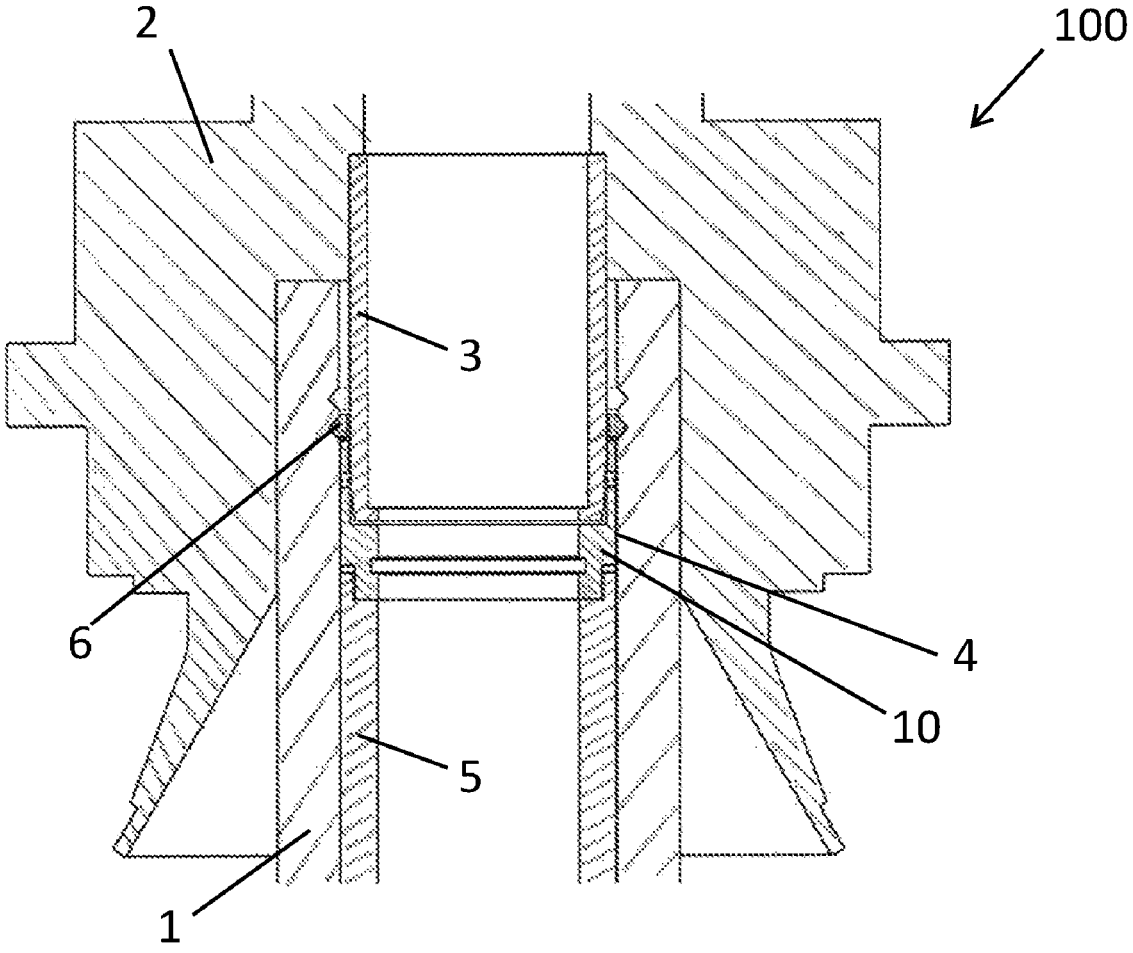
FIG. 1 shows parts of a wellhead arrangement according to an embodiment of the present invention.

In an embodiment, the seal can, for example, be arranged in a sealing relationship with an inner through-channel of the wellhead and a side wall of the isolation sleeve.

In an embodiment, the isolation sleeve can, for example, comprise a tapered section.

In an embodiment, a support surface can, for example, be provided in the wellhead, the support surface being arranged to prevent a movement of the seal carrier in a longitudinal direction of the inner through-channel. The support surface may be part of a casing hanger arranged in the wellhead.

In an embodiment, the wellhead arrangement can, for example, further comprise a locking unit, the locking unit being anchored in the through-channel and being arranged to prevent a movement of the seal carrier in a longitudinal direction of the inner through-channel.

In an embodiment, the wellhead can, for example, be a subsea wellhead.

In an embodiment, the present invention provides a method of installing a valve tree onto a wellhead, the method comprising the steps of: placing a seal carrier in an inner through-channel of the wellhead, and positioning the valve tree onto the wellhead so as to bring an isolation sleeve into sealing engagement with the seal carrier, wherein the step of placing the seal carrier in the inner through-channel is carried out prior to the step of positioning the valve tree onto the wellhead.

In an embodiment, the method can, for example, comprise energizing a seal in the seal carrier.

In an embodiment, the step of energizing the seal can, for example, comprise bringing the seal into engagement with a tapered section of the isolation sleeve.

In an embodiment, the step of placing a seal carrier in the inner through-channel can, for example, comprise positioning the seal carrier against a support surface in the wellhead, the support surface being arranged to prevent movement of the seal carrier in a longitudinal direction of the inner through-channel. The support surface may be part of a casing hanger arranged in the wellhead.

In an embodiment, the method can, for example, further comprise the step of installing a locking unit in the wellhead, whereby the locking unit is anchored in the inner through-channel and is arranged to prevent a movement of the seal carrier in a longitudinal direction of the inner through-channel.

In an embodiment, the wellhead can, for example, be a subsea wellhead.

Illustrative embodiments of the present invention are described below reference to the appended drawings.

When installing a valve tree (Christmas tree) onto a wellhead, the valve tree is commonly provided with an isolation sleeve attached to the tree which engages the wellhead bore upon connection. The isolation sleeve, or the wellhead through-channel (bore), has seals for sealing between the isolation sleeve and the wellhead when connected. In such processes, any inaccuracies during the installation or incorrect mating of parts can create problems, e.g., seal damage or suboptimal activation of the seal when the valve tree is installed onto the wellhead.

Figure 2:
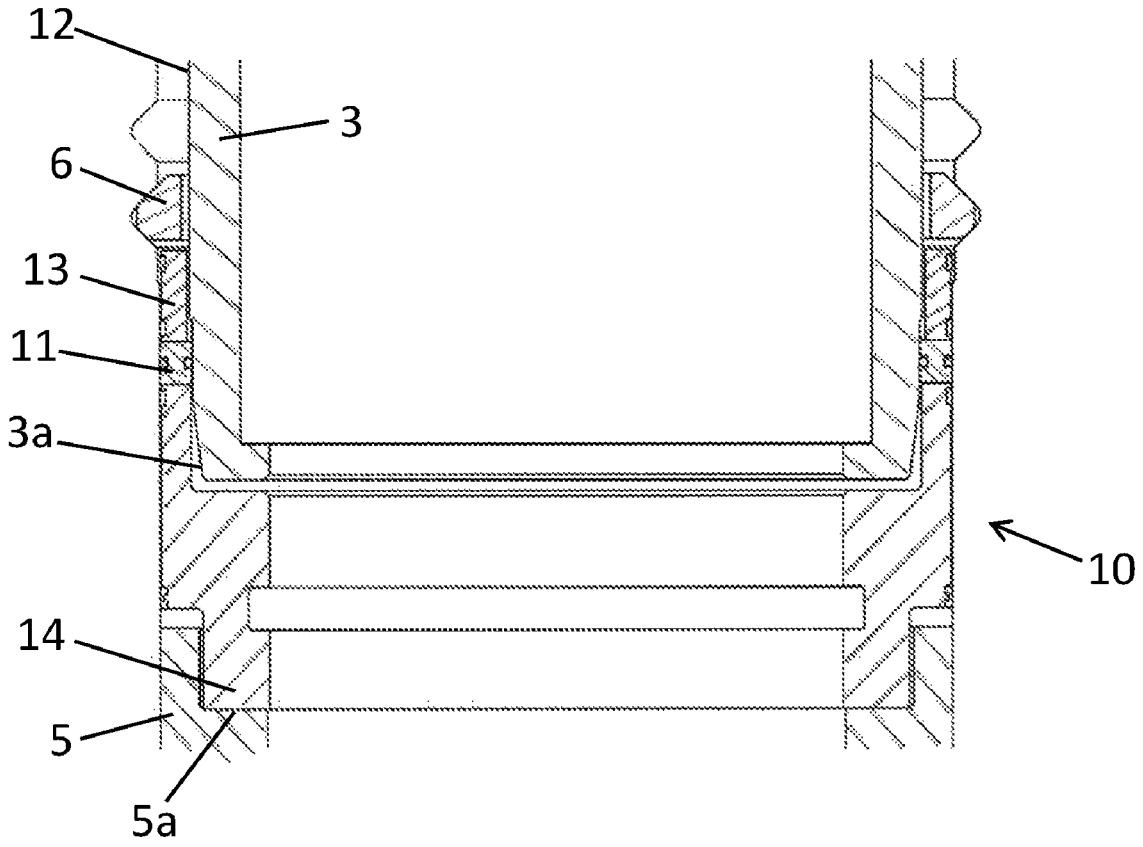
FIG. 2 shows details of certain components of the embodiment shown in FIG. 1.

FIGS. 1 and 2 show an embodiment with a wellhead arrangement 100 comprising a wellhead 1 having a valve tree 2 arranged thereon. The valve tree 2 has an isolation sleeve 3. The wellhead arrangement 100 further has an independent seal carrier 10 having at least one seal 11. The seal carrier 10 can be installed onto the wellhead 1 prior to landing the valve tree 2 and the isolation sleeve 3. Upon landing the valve tree 2, at least a part of the seal carrier 10 will then be in a position between an inner through-channel 4 of the wellhead 1 and the isolation sleeve 3, in sealing relationship with both the inner through-channel 4 and the side wall 12 of the isolation sleeve 3.

As best seen in FIG. 2, the isolation sleeve 3 can be arranged with a tapered section 3*a* at its front (lower) end. This reduces the risk of incorrect installation, and may be used to aid activation of the seal 11.

The seal carrier 10 is at its lower part 14 supported by a support surface 5*a* in the wellhead 1. The support surface 5*a* may be perpendicular to the longitudinal direction of the inner through-channel 4, or have an angle in relation to this direction. (The through-channel 4 is generally vertical in the regular, installed position of the wellhead 1.) The support surface 5*a* is arranged to prevent a downwards movement of the seal carrier 10 in a longitudinal (axial) direction of the inner through-channel 4. In the shown embodiment, the support surface 5*a* is part of, i.e., is arranged on, a casing hanger 5 arranged in the wellhead 1. The support surface 5*a* may, however, be arranged on a different wellhead component, or on the wellhead 1 itself.

Above the seal 11, a support ring 13 may be used to retain the seal 11 in place and to evenly distribute any axial load onto the seal 11.

The seal carrier 10 may be fixed by a locking unit 6 on its upper side, such as a wedge lock. The locking unit 6 is anchored in the through-channel 4 to prevent an upwards movement of the seal carrier 10 in a longitudinal (axial) direction of the inner through-channel 4. The seal carrier 10 can alternatively be anchored directly to the wellhead 1 to restrict an axial movement in both directions, for example, by a suitable connection between the support ring 13 and locking unit 6.

In an embodiment, the present invention provides a method of installing a valve tree 2 onto a wellhead 1, the method comprising the steps of placing a seal carrier 10 in an inner through-channel 4 of the wellhead 1 and subsequently positioning the valve tree 2 onto the wellhead 1 so as to bring an isolation sleeve 3 into a sealing engagement with the seal carrier 10.

The seal carrier 10 and the seal 11 can be designed so that the seal 11 is energized upon engagement with the isolation sleeve 3. The tapered section 3*a* of the isolation sleeve 3 may be designed to contribute to the energizing of the seal 11, and thus improve sealing performance and reduce the risk of contact between the seal 11 and the internal profile of the wellhead 1 during the installation process. The tapered section 3*a* thereby provides a transition profile which will expand the seal 11 gradually without damaging the seals 11 during expansion. The expansion enables a more robust seal engagement (higher contact force).

According to the embodiments described above, the seal carrier 10 can thus be pre-installed by tooling onto the wellhead 1, with its lower interface towards the casing hanger 5 (or another component in the wellhead 1), and its upper interface locked against the inner diameter profile of the wellhead 1 (in the through-channel 4), for example, via a wedge lock. For a subsea wellhead, this installation can, for example, be carried out using an ROV with appropriate tooling. The seal 11 can thereby be securely installed without interfering with the inner diameter profile of the wellhead, and with less risk of damaging the seal 11. When the isolation sleeve 3 is installed, the seal 11 will expand by the pressure from the outer wall 12 of the isolation sleeve 3, and the seal 11 will be energized to the correct contact pressure to enable a robust sealing arrangement between the valve tree 2 and the wellhead 1.

According to embodiments described herein, restrictions on, and risk associated with, landing operations can thus be reduced. This can help reduce operational cost and time for installation, as well as improve wellhead integrity and safety.

In the shown embodiment, the seal carrier 10 consists of four parts: the lower part 14, the seal 11, the support ring 13, and the locking unit 6. These individual parts can be installed together (e.g., pre-assembled prior to installation), or alternatively, one or more parts can be installed sequentially in the wellhead 1 through-channel 4. The locking unit 6 may or may not be part of the seal carrier 10; this unit may be a separate part and/or it may be an integral part of the isolation sleeve 3 carrying out the function of retaining the seal carrier 10.

The seal 11 can, for example, be made of a metallic or a polymeric material. Suitable materials may, for example, be HNBR, PEEK, a bronze alloy, titanium, a titanium alloy, or a combination thereof. Other parts of the seal carrier 10 can, for example, be made of a low alloy steel, a titanium alloy, or titanium.

In certain applications, embodiments of the present invention provide the possibility to replace the seal 11 between the wellhead 1 and the valve tree 2 (isolation sleeve 3) without having to retrieve the valve tree 2. This may, for example, be an advantage in a subsea arrangement, i.e., with a subsea wellhead 1, in that the valve tree 2 may not have to be retrieved to the surface to perform this operation. In such a case, one could release the valve tree 2 from the wellhead 1, lift the valve tree 2 a small distance (upwards and/or to the side), and exchange the seal carrier 10, for example, using an ROV. The valve tree 2 can then be re-installed onto the wellhead 1. This significantly reduces the time required for this operation, and may also allow more frequent replacement of the seal 11, to improve system safety and integrity.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The present invention is not limited to the embodiments described herein; reference should be had to the appended claims.

What is claimed is:

1. A wellhead arrangement comprising:

a valve tree arranged on a wellhead having an inner through channel, the valve tree comprising an isolation sleeve having a side wall; and a seal carrier comprising at least one seal, the seal carrier being supported by the wellhead and being arranged so that the at least one seal is between the wellhead and the isolation sleeve and so that the at least one seal is in a sealing relationship with the inner through-channel of the wellhead and with the side wall of the isolation sleeve, wherein the seal carrier is not secured to the isolation sleeve.

2. The wellhead arrangement as recited in claim 1, wherein the isolation sleeve further comprises a tapered section.

3. The wellhead arrangement as recited in claim 1, wherein the wellhead further comprises a support surface, the support surface being arranged to prevent a movement of the seal carrier in a longitudinal direction of the inner through-channel.

4. The wellhead arrangement as recited in claim 3, further comprising:

a casing hanger arranged in the wellhead, wherein, the support surface is part of the casing hanger.

5. The wellhead arrangement as recited in claim 1, further comprising:

a locking unit anchored in the inner through-channel, the locking unit being arranged to prevent a movement of the seal carrier in a longitudinal direction of the inner through-channel.

6. The wellhead arrangement as recited in claim 5, wherein the locking unit is only arranged to prevent the movement of the seal carrier in the longitudinal direction of the inner through-channel.

7. The wellhead arrangement as recited in claim 1, wherein the wellhead is a subsea wellhead.

8. A method of installing a valve tree onto a wellhead, the method comprising:

first placing a seal carrier in an inner through-channel of the wellhead so that the seal carrier is supported by the wellhead, the seal carrier comprising at least one seal; and then landing the valve tree and an isolation sleeve onto the wellhead so as to bring a side wall of an isolation sleeve into a sealing engagement with the at least one seal of the seal carrier and the at least one seal into a sealing engagement with the inner through-channel of the wellhead, wherein, the placing of the seal carrier in the inner through-channel of the wellhead comprises positioning the seal carrier against a support surface in the wellhead, the support surface being arranged to prevent a movement of the seal carrier in a longitudinal direction of the inner through-channel.

9. The method as recited in claim 8, further comprising: energizing the at least one seal in the seal carrier.

10. The method as recited in claim 9, wherein the step of energizing the at least one seal in the seal carrier comprises bringing the at least one seal into an engagement with a tapered section of the isolation sleeve.

11. The method as recited in claim 8, wherein the support surface is part of a casing hanger which is arranged in the wellhead.

12. The method as recited in claim 8, further comprising:

installing a locking unit in the wellhead, wherein, the locking unit is anchored in the inner through-channel and is arranged to prevent a movement of the seal carrier in a longitudinal direction of the inner through-channel.

13. The method as recited in claim 8, wherein the wellhead is a subsea wellhead.

14. A method of installing a valve tree onto a wellhead, the method comprising:

first placing a seal carrier in an inner through-channel of the wellhead so that the seal carrier is supported by the wellhead, the seal carrier comprising at least one seal; and then landing the valve tree and an isolation sleeve onto the wellhead so as to bring a side wall of an isolation sleeve into a sealing engagement with the at least one seal of the seal carrier and the at least one seal into a sealing engagement with the inner through-channel of the wellhead; and installing a locking unit in the wellhead, wherein, the locking unit is anchored in the inner through-channel and is arranged to prevent a movement of the seal carrier in a longitudinal direction of the inner through-channel.

15. The method as recited in claim 14, further comprising: energizing the at least one seal in the seal carrier.

16. The method as recited in claim 15, wherein the step of energizing the at least one seal in the seal carrier comprises bringing the at least one seal into an engagement with a tapered section of the isolation sleeve.

17. The method as recited in claim 14, wherein, the placing of the seal carrier in the inner through-channel of the wellhead comprises positioning the seal carrier against a support surface in the wellhead, the support surface being arranged to prevent a movement of the seal carrier in a longitudinal direction of the inner through-channel, and the support surface is part of a casing hanger which is arranged in the wellhead.

18. The method as recited in claim 14, wherein the wellhead is a subsea wellhead.

* * * * *